United States Patent [19]

Hipkins, Sr.

[11] Patent Number: 5,076,734

[45] Date of Patent: Dec. 31, 1991

[54] ROOF BOLT WITH PADDLE RESIN MIXER AND METHOD FOR MAKING THE SAME

[75] Inventor: Edward C. Hipkins, Sr., Oakdale, Pa.

[73] Assignee: H & S Machine and Supply Co., Inc., Oakdale, Pa.

[21] Appl. No.: 593,116

[22] Filed: Oct. 5, 1990

[51] Int. Cl.[5] ..... E21D 20/02

[52] U.S. Cl. ..... 405/259.5; 405/259.6

[58] Field of Search ..... 405/259, 260, 261, 262; 411/1, 2, 8, 9, 44, 82

[56] References Cited

U.S. PATENT DOCUMENTS

| | | | |
|---|---|---|---|
| 2,682,152 | 6/1954 | Bierer | 405/260 |
| 3,754,401 | 8/1973 | Lipow | 61/39 |
| 4,103,498 | 8/1978 | Steinborn et al. | 61/45 |
| 4,129,007 | 12/1978 | Rausch | 405/261 |
| 4,139,323 | 2/1979 | Brandstetter | 405/260 |
| 4,158,519 | 6/1979 | Gamlin | 405/260 |
| 4,162,133 | 7/1979 | Clark et al. | 405/258 |
| 4,187,040 | 2/1980 | Donan, Jr. | 405/259 |
| 4,193,715 | 3/1980 | Vass | 405/261 |
| 4,305,687 | 12/1981 | Parker | 405/260 |
| 4,313,696 | 2/1982 | Horten | 405/259 |
| 4,334,805 | 6/1982 | Morgan | 405/261 |
| 4,362,440 | 12/1982 | Glaesmann et al. | 405/269 |
| 4,516,883 | 5/1985 | Zeitler | 405/260 |
| 4,519,735 | 5/1985 | Machtle | 411/44 |
| 4,611,954 | 9/1986 | Cassidy | 405/261 |
| 4,650,373 | 3/1987 | Seegmiller | 405/260 |
| 4,655,645 | 4/1987 | Hipkins, Sr. et al. | 405/261 |
| 4,664,561 | 5/1987 | Frease | 405/261 |
| 4,666,345 | 5/1987 | Seegmiller | 405/260 |
| 4,850,746 | 7/1989 | Finsterwalder et al. | 405/260 |
| 4,904,122 | 2/1990 | Herbst et al. | 405/260 |

*Primary Examiner*—David H. Corbin

*Attorney, Agent, or Firm*—Webb, Burden, Ziesenheim & Webb

[57] ABSTRACT

A mine roof anchor assembly usable with a quick-setting resin cartridge inserted into a mine roof opening including an elongated bolt having a first end and a second end, the bolt being threaded for a portion of its length at the second end. A mechanical anchor is carried on the threaded portion of the bolt and extends along a longitudinal axis in a longitudinal direction. The anchor assembly further includes a resin mixer attached to the bolt extending below the mechanical anchor toward the first end. The resin mixer includes an open-ended hollow sleeve having flared ends integral with a tube-like section positioned therebetween. The sleeve also includes at least one outwardly extending integral fin extending in the longitudinal direction and having a maximum radial distance from the central longitudinal axis less than the mine roof opening radius. A frangible element may also be carried on the elongated bolt between the mechanical anchor and the resin mixer. A method of manufacturing a roof bolt assembly having a resin mixer is also disclosed.

26 Claims, 2 Drawing Sheets

ROOF BOLT WITH PADDLE RESIN MIXER AND METHOD FOR MAKING THE SAME

BACKGROUND OF THE INVENTION

1. Field of the Invention

This invention relates to roof bolts and, more particularly, to a roof bolt which is positioned in a bore hole drilled in a rock formation in a mine roof and which is held in place within the bore by both a mechanical anchor and a quick-setting resin. 2. Description of the Prior Art It is a well-established practice in underground mining work, such as coal mining, tunnel excavation or the like, to reinforce or support the mine roof to prevent rock falls or cave-ins. A common means presently used to support mine roofs is an elongated bolt which is inserted into the rock formation above the mine roof in a bore hole and which is securely fixed to the bore hole by an anchoring means such as a mechanical anchor, a quick-setting resin which surrounds the end of the bolt within the hole, or both. The roof bolt, placed under the tension, is used to hold a metal support plate in close engagement with the roof.

The roof bolt described in U.S. Pat. No. 4,655,645 combines the features of a mechanical anchor and resin bonding but also provides positive and complete mixing of the resin components by an additional mixing mechanism. This arrangement forces the resin upwards along the bolt during mixing, more violently mixes the resin for a shorter mix time, and eliminates the use of a two-position coupling or delay mechanism. Although this arrangement is relatively inexpensive and easy to manufacture compared to other mine roof bolt mixing arrangements, the mining industry, which uses millions of units each year, continues to seek improved roof anchor bolts having improved characteristics and lesser costs.

Therefore, it is an object of the present invention to provide an anchor bolt assembly with a mixing assembly that is less expensive and easier to manufacture than that of the prior art, but which proved excellent resin mixing characteristics.

SUMMARY OF THE INVENTION

My invention is a resin-based mine roof anchor assembly for insertion into a mine roof bore hole. The mine roof anchor assembly includes an elongated bolt having a first end and a second end, and extending along a central longitudinal axis The mine roof anchor assembly further includes a resin mixer attached to the bolt between the first end and the second end. The resin mixer includes an open hollow sleeve having a first open end and a second open end. The sleeve can be formed from metal. The sleeve has a tube-like section carried by and coaxial with the bolt and extending in the longitudinal direction. The sleeve includes at least one outwardly extending, integral fin extending in the longitudinal direction, with the maximum radial distance of the fin from the central longitudinal axis less than the bore hole radius. The tube-like section can have an internal diameter approximately equal to the outer diameter of the bolt.

The sleeve can have a first flared section with a first end and a second end. The first end of the first flared section defines the first open end of the sleeve. The second end of the first flared section is positioned adjacent to the tube-like section and has an internal diameter approximately equal to the internal diameter of the tube-like section. The first flared section has an inner surface with an internal diameter that varies along the central longitudinal axis, with the internal diameter of the first end of the first flared end section greater than the internal diameter of the second end of the first flared section. The sleeve can also include a second flared section positioned opposite the first flared section. The second flared section has a third end and a fourth end, with the third end defining the second open end of the sleeve and the fourth end positioned adjacent to the tube-like section and having an internal diameter approximately equal to the internal diameter of the tube-like section. The second flared section has an internal diameter that varies along the central longitudinal axis and the internal diameter of the third end of the second flared section is greater than the internal diameter of the fourth end of the second flared section. The flared sections can be positioned adjacent to and in close proximity to the mine roof bore hole wall to retard the flow of resin between the wall and the flared section first end.

The sleeve can include a first pair of fins positioned approximately 180° apart on opposite sides of the tube-like section The sleeve can also include a second pair of fins radially positioned 180° apart on opposite sides of the tube-like section, with each of the fins radially spaced from adjacent fins by approximately 90°.

The tube-like section can further include a first portion and a second portion, with the first portion positioned adjacent the first end of the tube-like section and the second portion positioned adjacent the second end of the tube-like section. One set of the fins can be positioned on the first portion and the other set of the fins can be positioned on the second portion The fins can include a resin passage notch, such as a V-shaped notch. The notch can be positioned on an outer edge positioned away from the tube-like member along the edge.

The mine roof anchor assembly can further include a frangible element, such as a hollow plastic sleeve, that is in contact with the first flared section. The frangible hollow plastic sleeve can rest on an inner surface of the first flared section.

The invention is also directed to a method of manufacturing a mine roof anchor assembly having an elongated bolt. The method includes the steps of: passing a portion of the bolt through a hollow tube, with the hollow tube having an internal diameter greater than that of the outer diameter of the bolt; positioning two or more forming dies about an outer surface of the tube; pressing the forming dies against the surface of the tube; and forming a sleeve having a tube-like structure and having at least one outwardly extending integral fin. The tube-like structure has an internal diameter which is substantially the same as the outer diameter of the bolt so that the tube-like structure is carried by and press-fitted on the bolt. The method can further include the step of forming a flared section on an end of the tube.

DETAILED DESCRIPTION OF THE PREFERRED EMBODIMENTS

Figure 1:
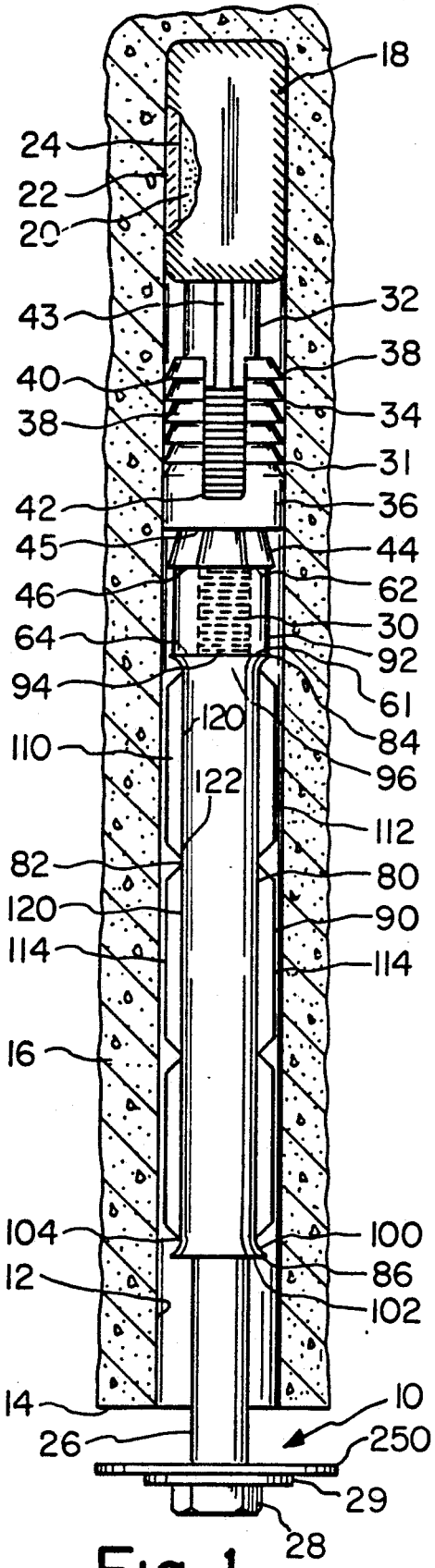
FIG. 1 is a side elevational view, partially in section, showing a rock formation having a bore hole with a first embodiment of a roof bolt assembly containing a resin mixer made in accordance with the present invention in place just prior to rupture of a resin cartridge.

Referring now to FIGS. 1-4, there is shown a first embodiment of a roof bolt assembly, generally designated 10, in accordance with the present invention. The roof bolt 10 is an elongated member positioned within a bore hole 12 which is drilled through a mine roof surface 14 and into the rock formation 16 above a mine entry. A quick-setting resin cartridge 18 is positioned in the blind or upward end of the bore hole 12. The resin cartridge 18 is basically an enclosed, elongated tube which includes two components, an active agent 20 and a reaction agent 22 of a resin grouting mix, separated by a membrane 24.

The roof bolt assembly 10 includes an elongated bolt shaft 26 with a head 28 on one end and with threads 30 at the other end. A two-faced friction reducing washer 29, is positioned immediately above and rests on the head 28. An expansion anchor 31 comprising a tapered nut or spreader 32, having an internally threaded axial bore and an expansion shell or gripping member 34, is carried on the threaded end 30 of the bolt shaft 26. The gripping member 34 is formed with a circular collar 36 at its base and with a plurality of radially expandable gripping fingers 38 extending integrally therefrom. Each gripping finger 38 is provided on its external surface with a plurality of gripping teeth 40 or other gripping or engagement mechanism. The gripping fingers 38 are preferably spaced apart from one another by a narrow vertical slot 42. The outer diameter of the gripping member 34 is slightly greater than the diameter of the bore hole 12 so that the gripping member 34 is held in place when the roof bolt assembly 10 is positioned into the bore hole 12.

The spreader 32 has a downwardly tapered configuration with an enlarged upper end and a smaller lower end. A portion of the inner surface of each gripping finger 38 abuts the tapered outer surface of the spreader 32. An elongated key 43 on the outer surface of the spreader 32 and integral therewith is positioned within the vertical slot 42 between an adjacent pair of gripping fingers 38 and helps to keep the gripping member 34 from rotating along with the spreader 32 when the bolt shaft 26 is rotated.

A first support 44, such as a hexagonal stamped support nut, is threadably received on the threaded end 30 of the bolt shaft 26 and is positioned directly beneath the circular collar 36 of the gripping member 34 with the gripping member 34 typically resting thereon. One stamped support nut which works well in this application is a Palnut ® support nut. The stamped support nut 44 is preferably a stamped sheet metal nut and includes a first surface 45 having a bore therethrough that threadably receives the threaded bolt shaft 26 and upon when the circular collar 36 of the gripping member 34 rests, and six tabs 46 depending downwardly from the outer peripheral edge of the first surface 45.

A plastic sleeve 61, similar in the shape of a hollow cylindrical shell, is received by the bolt 10 and positioned about a portion of the threaded end extending below the mechanical anchor toward the head 28. The outer diameter of the sleeve 61 is slightly less than the outer diameter of the first support 44 so that a top edge 62 of the sleeve 61 rests against the underside of the first surface 45 of the first support 44 and the outer surface of the sleeve 61 is surrounded by the tabs 46. A bottom edge 64 of the sleeve 61 abuts against a resin mixer or paddle mixer 80.

The paddle mixer 80 is received by the bolt 10 and is positioned about both the threaded portion and the unthreaded portion of the bolt shaft 26 extending below the sleeve 61 toward the head 28. The paddle mixer 80 is fixedly attached to the bolt typically by a press-fit; however, the paddle mixer 80 may be attached by any method such as bolting or adhesives. The paddle mixer 80 includes an open-ended sleeve 82 having a first open end 84, a second open end 86 and a tube-like section 88 therebetween carried by the bolt shaft 26. The tube-like section 88 extends in the longitudinal direction and is coaxial with the bolt shaft 26. The tube-like section 88 has an internal diameter approximately equal to the outer diameter of the adjacent bolt shaft 26. The first open end 84 of the paddle mixer 80 includes a first flared section 92 having a first end 94 defining the first open end 84 of the sleeve 82 and a second end 96 integral with and adjacent to the tube-like section 88. The first flared section 92 has an inner surface 97 with an internal diameter that varies along a central longitudinal axis 98, with the internal diameter of the first end 94 of the first flared section 92 greater than the diameter of the bolt shaft 26 and the internal diameter of the second end 96 of the first flared section 92 equal to the internal diameter of the tube-like section 88. The bottom edge 64 of the sleeve 61 is received by the first flared section 92 and contacts the inner surface 97 by resting thereon.

The second open end 86 of the paddle mixer 80 includes a second flared section 100 having a third end 102 defining the second open end 86 of the sleeve 82 and a fourth end 104 integral with and adjacent to the tube-like section 88. The second flared section 100 has an inner surface with an internal diameter that varies along the longitudinal axis 98, with the internal diameter of the third end 102 of the second flared section 100 greater than the diameter of the bolt shaft 26 and the internal diameter of the fourth end 104 of the second flared section 100 equal to the internal diameter of the tube-like section 88. The outer diameter of the first end 94 of the first flared section and the third end 102 are less than the diameter of the bore hole 12. Preferably, the third end 102 is in close proximity to the wall of the bore hole 12, for example within 1/16", to retard the flow of resin between the wall and the second flared section 100.

Two fins 110 and 112 are provided on the tube-like section 88. Specifically, the fins 110 and 112 are spaced 180° apart from each other on opposite sides of the tube-like structure 88. Since fins 110 and 112 are identical, only fin 110 will be discussed in detail. Fin 110 extends in the longitudinal direction and has an outer surface 114. The maximum radial distance of the outer surface 114 of fin 110 from the central longitudinal axis 98 is less than the radius of the bore hole 12. Fin 110 extends substantially along the entire length of the tube-like section 88. Three fin segments 120 are defined along the length of fin 110 by V-shape notches 122. The notches 122 are defined along an outer edge of the fin 110 and permit the resin to flow therethrough. This permits superior mixing of the resin components as compared to the absence of such notches.

Figure 6:
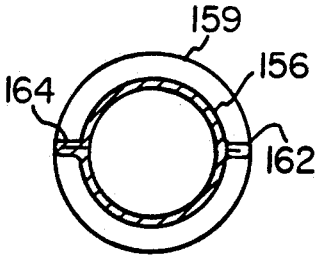
FIG. 6 is a section taken along lines VI-VI in FIG. 5.
Figure 5:
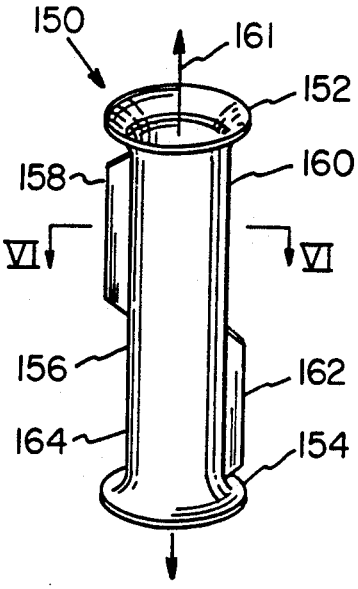
FIG. 5 is a side perspective view of a second embodiment of a resin mixer made in accordance with the present invention.

A second embodiment of a paddle mixer 150 is shown in FIGS. 5 and 6. Paddle mixer 150 is similar to paddle mixer 80 discussed above, with the exception of the placement of the fins. Paddle mixer 150 includes a first flared section 152 and a second flared section 154 integrally attached to respective ends of a tube-like section 156. A first fin 158 extends from a first portion 160 of the tube-like section 154 along a longitudinal axis 161 for approximately one half the length of the tube-like section 154. A second fin 162 extends from a second portion 164 of the tube-like section 154 along the longitudinal axis 161 for approximately one-half the length of the tube-like section 154. The first portion 160 is adjacent to the first flared section 152 and the second portion 164 is adjacent to the second flared section 154. Fins 158 and 162 are also spaced 180° apart on opposite sides of the tube-like structure 88. Further, the maximum radial distance of outer surfaces of fins 158, 162 from the longitudinal axis 161 is less than the radius of the bore hole 12.

Figure 7:
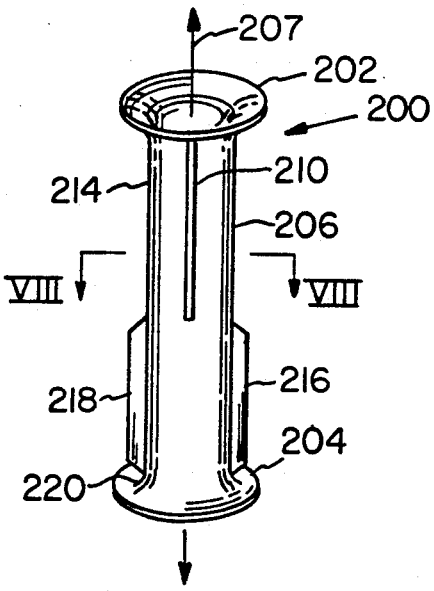
FIG. 7 is a side elevational view of a third embodiment of a resin mixer made in accordance with the present invention.
Figure 8:
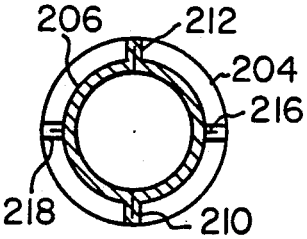
FIG. 8 is a section taken along lines VIII-VIII in FIG. 7.

A third embodiment of a paddle mixer 200 is shown in FIGS. 7 and 8. Paddle mixer 200 is similar to paddle mixer 150, with the exception of the fin arrangement. Paddle mixer 200 includes a first flared section 202 and a second flared section 204 integrally attached to respective ends of a tube-like section 206. A first pair of fins 210, 212 extend from a first portion 214 of the tube-like section 206 along a longitudinal axis of the shaft 207. Fins 210, 212 are positioned 180° apart from each other and have a length approximately equal to one-half the length of the tube-like section 206. A second pair of fins 216, 218 extend from a second portion 220 of the tube-like section 206 along the longitudinal axis 207. Fins 216, 218 are positioned 180° apart from each other and have a length approximately equal to half the length of the tube-like section 206. Each of the fins 210, 212, 216 and 218 is spaced 90° apart from an adjacent fin. The maximum radial distance of respective outer surfaces of fins 210, 212, 216 and 218 from the longitudinal axis 207 is less than the radius of the bore hole 12.

Figure 2:
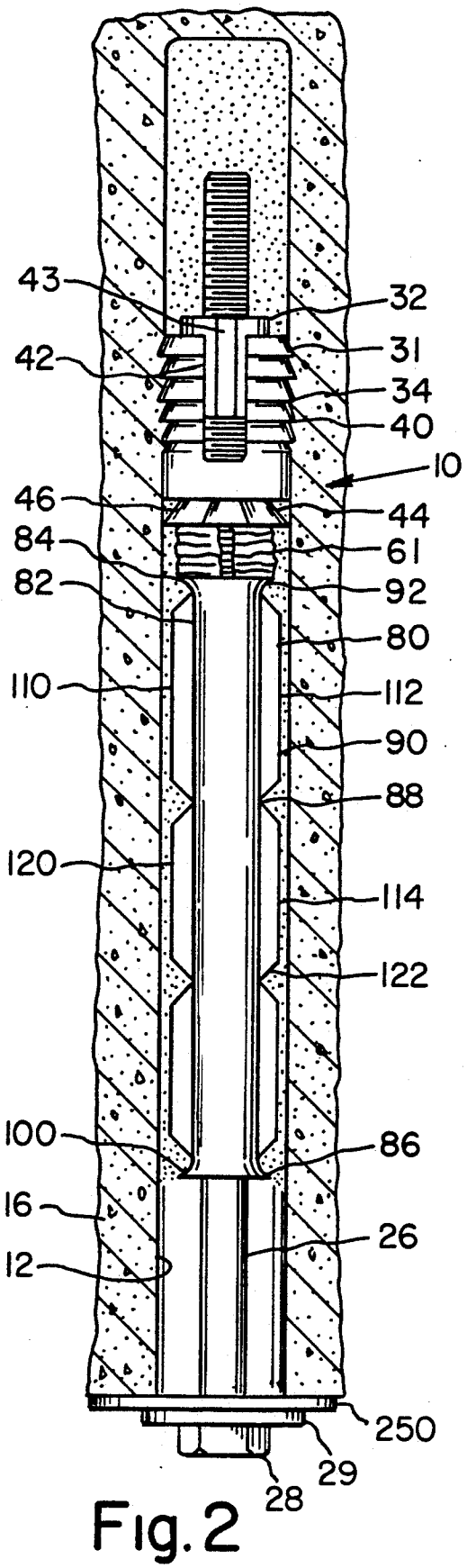
FIG. 2 is a side elevational view similar to FIG. 1 showing the roof bolt assembly as it is finally installed in the bore hole.
Figure 4:
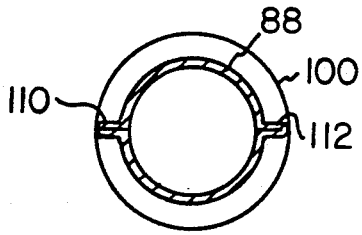
FIG. 4 is a section taken along lines IV-IV in FIG. 3.
Figure 3:
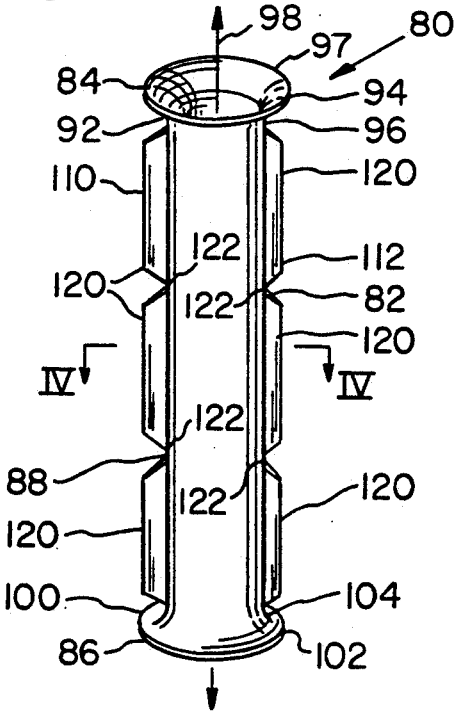
FIG. 3 is a side perspective view of the resin mixer shown in FIG. 1.

Any of the above-described paddle mixers may be used on the bolt 10. Preferably, the paddle mixers 80, 150 and 200 are made of metal which can be formed by a stamping operation. The paddle mixers may be formed by the following method. First a portion of the bolt shaft 26 passes through a hollow metal tube having an internal diameter greater than that of the outer diameter of the bolt shaft 26. Flared ends, such as ends 92 and 100, can be formed on the ends of the tube prior to or after the tube is received by the bolt shaft 26. Two or more forming dies are then positioned about an outer surface of the tube. The forming dies are then pressed against the outer surface of the tube forming respective fins and compressing the internal diameter of the tube to be equal to that of the outer diameter of the bolt shaft 26. The paddle mixer is then frictionally held in place on the bolt shaft 26. Notches can then be cut along the length of the fins as shown in FIGS. 1–3.

The operation of the roof bolt assembly 10 is as follows. Initially, a resin cartridge 18 is placed in the bore hole 12 above the roof bolt 10 and the roof bolt 10 is advanced upwardly into the bore hole 12. FIG. 1 shows the arrangement just prior to the rupture of the resin cartridge 18. The roof bolt 10 then continues to advance into the bore hole 12 and ruptures the resin cartridge 18. At the same time, the components 20, 22 of the ruptured resin cartridge 18 are forced downward from the upward displacement of the anchor assembly.

The bolt head 28, and hence, the entire bolt shaft 26, is rotated continuously in one direction and is drawn upward until a support plate 250 located immediately above the washer 31 and head 28 and in contact with the washer 31 comes into contact with the mine roof surface 14. Continued rotation draws the expansion anchor 31 and the stamped support nut 44 downward against the abutting sleeve 61 and then causes the spreader 32 to move downwardly along the threads 30. This downward movement of the spreader 32 causes the gripping fingers 38 to expand radially outward and force the gripping teeth 40 into a secure engagement with the rock formation 16 surrounding the bore hole 12, at which time the stamped support nut 44 and the sleeve 61 fail as shown in FIG. 2. The sleeve 61 prevents slippage which otherwise would occur because of the initial lubricating effect of the resin about the bore hole.

While the roof bolt 10 is being rotated, the resin mixer 80 is simultaneously being rotated. The resin components 20, 22 were previously forced down to the vicinity of the paddle mixer 80 when the bolt 10 was advanced upwardly. The second flared section 100 retards the flow of the resin components 20, 22 toward the bolt head 28, insuring that the resin components completely fill the annulus surrounding the upper portion of the roof bolt 10. The action of rotating the fins 110 and 112 violently mixes the resin components 20, 22. The notches 122 aid in the mixing of the components. The final curing of the resin to its ultimate rigid condition occurs after the rotation of the bolt 10 has stopped.

An actual ¾" mine roof bolt has been made with a paddle resin mixer disclosed in FIGS. 1–4. The length of the paddle resin mixer was 12" and the fins extended approximately 0.25" from the outer surface of the tube-like section. The paddle mixer was made from a cold rolled sheet metal tube having a thickness of 0.064".

The above-described paddle mixers 80, 150 and 200 can be manufactured for less cost than that of other resin mixers, such as the helical coil mixer disclosed in U.S. Pat. No. 4,655,645. This is because the helical coil must be separately formed and then separately affixed to the mine roof bolt shaft as opposed to being simultaneously formed and affixed to the mine roof bolt shaft. Further, less resin is required to install the roof bolt assembly 10 because the second flared section 100 prevents excess resin from flowing down the bolt shaft 26 toward the head 28.

Having described presently the preferred embodiments of this invention, it is to be understood that it may be otherwise embodied within the scope of the following claims.

I claim:

1. A mine roof anchor assembly for insertion into a mine roof bore hole and for use with a resin, comprising:

(a) an elongated bolt having a first end for insertion into the bore hole and a second end, and extending along a central longitudinal axis in a longitudinal direction; and (b) a resin mixer attached to said bolt between said first end and said second end, said resin mixer comprising an open-ended hollow sleeve having a first open end and a second open end, said first open end positioned closer to the bolt first end than said second open end and positioned in spaced relationship from said bolt, said sleeve having a tube-like section carried by said bolt and being coaxial therewith, said tube-like section extending in the longitudinal direction, said sleeve including at least one outwardly extending integral fin extending in the longitudinal direction, wherein the maximum radial distance of the fin from the central longitudinal axis is less than the bore hole radius.

2. The mine roof anchor assembly of claim 1 wherein said tube-like section has an internal diameter approximately equal to the outer diameter of the bolt.

3. The mine roof anchor assembly of claim 1 wherein said sleeve has a first flared section with a first end and a second end, said first end of said first flared section defining said first open end of said sleeve, said second end of said first flared section positioned adjacent to said tube-like section and having an internal diameter approximately equal to the internal diameter of said tube-like section, and said first flared section having an inner surface with an internal diameter that varies along the central longitudinal axis, with the internal diameter of the first end of said first end of said flared section greater than the internal diameter of the second end of said first flared section.

4. The mine roof anchor assembly of claim 3 wherein said sleeve has a second flared section positioned opposite said first flared section and having a third end and a fourth end, said third end defining said second open end of said sleeve and said fourth end positioned adjacent to said tube-like section and having an internal diameter approximately equal to the internal diameter of said tube-like section, said second flared section having an internal diameter that varies along the central longitudinal axis, with the internal diameter of the third end of said second flared section greater than the internal diameter of the fourth end of said second flared section.

5. The mine roof anchor assembly of claim 1 wherein said sleeve is formed from metal.

6. The mine roof anchor assembly of claim 1 wherein said sleeve has a first pair of fins positioned approximately 180° apart on opposite sides of said tube-like section.

7. The mine roof anchor assembly of claim 6 wherein said sleeve has a second pair of said fins radially positioned 180° apart on opposite sides of said tube-like section and each of said fins of said sleeve radially spaced apart by approximately 90° from adjacent fins.

8. The mine roof anchor assembly of claim 6 wherein said tube-like section includes a first portion and a second portion, said first portion positioned adjacent to said first end of said sleeve and said second portion positioned adjacent said second end of said sleeve, and one of said fins is positioned on said first portion and the other of said fins is positioned on said second portion.

9. The mine roof anchor assembly of claim 7 wherein said first pair of said fins is positioned on a first portion of said tube-like section and a second pair of fins is positioned on a second portion of said tube-like section, said first portion adjacent to said first end of said sleeve and said second portion adjacent to said second end of said sleeve.

10. The mine roof anchor assembly of claim 1 wherein said fin has a resin passage notch.

11. The mine roof anchor assembly of claim 10 wherein said fin has an outer edge positioned away from said tube-like member and said notch is defined along said edge.

12. The mine roof anchor assembly of claim 11 wherein said notch is V-shaped.

13. The mine roof anchor assembly of claim 3 wherein said bolt is threaded for a portion of its length at said second end of said bolt and said bolt further includes a frangible element received by said threaded portion and wherein contacting said first flared section.

14. The mine roof anchor assembly of claim 13 wherein said frangible element is a plastic sleeve.

15. The mine roof anchor assembly of claim 14 wherein said frangible plastic sleeve rests upon the inner surface of said first flanged section.

16. The mine roof anchor assembly of claim 3 wherein said first end of said flared section is positioned adjacent to and in close proximity to the mine roof bore hole wall to retard the flow of resin between the wall and the flared section first end.

17. A mine roof anchor assembly for insertion into a mine roof bore hole for use with a resin, comprising:

(a) an elongated bolt having a first end for insertion into the bore hole and a second end, said bolt threaded for a portion of its length at said second end;

(b) a mechanical anchor carried on said threaded portion of said bolt, and extending along a central longitudinal axis in a longitudinal direction; and (c) a resin mixer attached to said bolt extending below said mechanical anchor toward said first end, said resin mixer comprising an open-ended hollow sleeve having a first open end and a second open end, said first open end positioned closer to the bolt first end than said second open end and positioned in spaced relationship from said bolt, said sleeve having a tube-like section carried by said bolt and being coaxial therewith, said tube-like section extending in the longitudinal direction, said sleeve also including at least one outwardly extending integral fin extending in the longitudinal direction having a maximum radial distance from the central longitudinal axis less than the bore hole radius.

18. The mine roof anchor assembly of claim 17 wherein said bolt further comprises a frangible element receivd by said threaded portion and positioned between said mechanical anchor and said resin mixer first open end.

19. A mine roof anchor assembly for insertion into a mine roof bore hole and for use with a resin, comprising:

(a) an elongated bolt having a first end and a second end, and extending along a central longitudinal axis in a longitudinal direction; and (b) a resin mixer attached to said bolt between said first end and said second end, said resin mixer comprising an open-ended hollow sleeve having a first open end and a second open end, said sleeve having a tube-like section carried by said bolt and being coaxial therewith, said tube-like section extending in the longitudinal direction, said sleeve including at least one outwardly extending integral fin extending in the longitudinal direction, wherein the maximum radial distance of the fin from the central longitudinal axis is less than the bore hole radius, and said sleeve having a first flared section with a first end and a second end, said first end of said first flared section defining said first open end of said sleeve, said second end of said first flared section positioned adjacent to said tube-like section and having an internal diameter approximately equal to the internal diameter of said tube-like section, and said first flared section having an inner surface with an internal diameter that varies along the central longitudinal axis, with the internal diameter of the first end of said first end of said flared section greater than the internal diameter of the second end of said first flared section.

20. The mine roof anchor assembly of claim 19 wherein said sleeve has a second flared section positioned opposite said first flared section and having a third end and a fourth end, said third end defining said second open end of said sleeve and said fourth end positioned adjacent to said tube-like section and having an internal diameter approximately equal to the internal diameter of said tube-like section, said second flared section having an internal diameter that varies along the central longitudinal axis, with the internal diameter of the third end of said second flared section greater than the internal diameter of the fourth end of said second flared section.

21. The mine roof anchor assembly of claim 19 wherein said bolt is threaded for a portion of its length at said second end of said bolt and said bolt further includes a frangible element received by said threaded portion and wherein contacting said first flared section.

22. The mine roof anchor assembly of claim 21 wherein said frangible element is a plastic sleeve.

23. The mine roof anchor assembly of claim 22 wherein said frangible plastic sleeve rests upon the inner surface of said first flanged section.

24. The mine roof anchor assembly of claim 19 wherein said first end of said flared section is positioned adjacent to and in close proximity to the mine roof bore hole wall to retard the flow of resin between the wall and the flared section first end.

25. A mine roof anchor assembly for insertion into a mine roof bore hole and for use with a resin, comprising:

(a) an elongated bolt having a first end and a second end, and extending along a central longitudinal axis in a longitudinal direction;

(b) a resin mixer attached to said bolt between said first end and said second end, said resin mixer comprising an open-ended hollow sleeve having a first open end and a second open end, said sleeve having a tube-like section carried by said bolt and being coaxial therewith, said tube-like section extending in the longitudinal direction, said sleeve including a pair of outwardly extending integral fins extending in the longitudinal direction, wherein the maximum radial distance of each of said fins from the central longitudinal axis is less than the bore hole radius, said pair of fins positioned approximately 180° apart on opposite sides of said tube-like section and said tube-like section includes a first portion and a second portion, said first portion positioned adjacent to said first end of said sleeve and said second portion positioned adjacent said second end of said sleeve, and one of said fins is positioned on said first portion and the other of said fins is positioned on said second portion.

26. A mine roof anchor assembly for insertion into a mine roof bore hole and for use with a resin, comprising:

(a) an elongated bolt having a first end and a second end, and extending along a central longitudinal axis in a longitudinal direction;

(b) a resin mixer attached to said bolt between said first end and said second end, said resin mixer comprising an open-ended hollow sleeve having a first open end and a second open end, said sleeve having a tube-like section carried by said bolt and being coaxial therewith, said tube-like section extending in the longitudinal direction, said sleeve having two pairs of outwardly extending integral fins extending in the longitudinal direction, wherein the maximum radial distance of each of the fins from the central longitudinal axis is less than the bore hole radius, said first pair of fins positioned 180° apart on opposite sides of said tube-like section and said second pair of said fins radially positioned 180° apart on opposite sides of said tube-like section with each of said fins of said sleeve radially spaced apart by approximately 90° from adjacent fins, and said first pair of said fins positioned on a first portion of said tube-like section and a second pair of fins positioned on a second portion of said tube-like section, said first portion adjacent to said first end of said sleeve and said second portion adjacent to said second end of said sleeve.

* * * * *